US011554463B2

(12) United States Patent
Hall

(10) Patent No.: US 11,554,463 B2
(45) Date of Patent: Jan. 17, 2023

(54) CLAMP MOUNT

(71) Applicant: Taylor James Hall, Palatine, IL (US)

(72) Inventor: Taylor James Hall, Palatine, IL (US)

(73) Assignee: Nomis LLC, Palatine, IL (US)

( * ) Notice: Subject to any disclaimer, the term of this patent is extended or adjusted under 35 U.S.C. 154(b) by 79 days.

(21) Appl. No.: 16/691,166

(22) Filed: Nov. 21, 2019

(65) Prior Publication Data

US 2021/0154801 A1 May 27, 2021

(51) Int. Cl.
*B25B 5/16* (2006.01)

(52) U.S. Cl.
CPC ..... *B25B 5/16* (2013.01)

(58) Field of Classification Search
CPC ..... B25B 5/16; B25B 5/163; B25B 5/166; B25B 5/00; B25B 5/006; B25B 5/10; B25B 5/105; B25B 5/106; B25B 5/108; B25B 5/104; B25B 5/067; B25B 5/068; B25B 5/127; B25B 7/123; Y10T 29/53961; B23Q 1/42; B23Q 3/102; F16B 37/045
USPC ..... 269/95
See application file for complete search history.

(56) References Cited

U.S. PATENT DOCUMENTS 1,026,475 A 5/1912 Tarbuck
1,808,318 A 6/1931 Pleister
1,820,667 A * 8/1931 Leyes ..... F16B 37/045 269/93
1,954,708 A 4/1934 Mass
2,463,966 A 3/1949 Hauschild
2,525,198 A 10/1950 Beijl
2,577,029 A 12/1951 Moorehead
2,625,861 A 1/1953 Swanson
2,627,787 A 2/1953 Zitner
2,658,540 A 11/1953 Sobaski
2,705,441 A * 4/1955 Armstrong ..... B23Q 3/06 269/91
2,955,504 A 10/1960 Lovrinch et al.
2,983,289 A 5/1961 McKinley
2,988,122 A 6/1961 Stevens et al.
3,124,347 A 3/1964 Haddad
3,171,321 A 3/1965 Fischer
D228,224 S 8/1973 Schlanger
3,941,364 A 3/1976 Hjelm et al.
3,984,092 A * 10/1976 Fitzpatrick ..... B25B 5/163 269/88
4,245,827 A 1/1981 Goff et al.
4,432,538 A * 2/1984 Sequin ..... B25B 5/061 269/92

(Continued)

OTHER PUBLICATIONS

U.S. Appl. No. 29/681,897, Hall, filed Feb. 28, 2019.

(Continued)

*Primary Examiner* — Lee D Wilson
*Assistant Examiner* — Michael A Gump
(74) *Attorney, Agent, or Firm* — Reinhart Boerner Van Deuren P.C.

(57) ABSTRACT

A clamp mount and clamp assembly using a clamp mount are provided. The clamp mount is used to attach a clamp to a workbench or other support device so that a workpiece can be clamped to a work surface. The clamp mount may include a removable shoe. The clamp mount may include a plurality of attachment plates for attaching the clamp mount to different supports or different mounting features of the support device.

22 Claims, 7 Drawing Sheets

(56) References Cited

U.S. PATENT DOCUMENTS

| | | | | |
|---|---|---|---|---|
| 4,470,586 | A | 9/1984 | Spencer | |
| 4,475,728 | A | 10/1984 | Haddad | |
| D278,024 | S | 3/1985 | Hoffman | |
| 4,957,402 | A * | 9/1990 | Klein | F16B 37/045 411/166 |
| 4,989,654 | A | 2/1991 | Berkeley | |
| 5,165,673 | A * | 11/1992 | Newton, Jr. | A01K 97/28 269/69 |
| 5,443,554 | A | 8/1995 | Robert | |
| 5,584,254 | A | 12/1996 | Williams | |
| 5,617,909 | A | 4/1997 | Duginske | |
| 6,394,712 | B1 | 5/2002 | Weinstein et al. | |
| 6,446,313 | B2 | 9/2002 | Pfister | |
| 6,893,012 | B2 | 5/2005 | Wong | |
| 6,932,335 | B1 | 8/2005 | Dykstra | |
| 7,272,994 | B1 | 9/2007 | Johnson | |
| D561,008 | S | 2/2008 | Jones | |
| 7,465,128 | B2 | 12/2008 | Bruneau | |
| D627,614 | S | 11/2010 | Flint | |
| 7,922,130 | B2 | 4/2011 | Hawkins | |
| 7,980,538 | B1 | 7/2011 | Weiby | |
| 8,104,754 | B1 | 1/2012 | Clark | |
| 8,469,343 | B2 | 6/2013 | Clark | |
| D687,693 | S | 8/2013 | Caudle | |
| 9,120,205 | B2 | 9/2015 | Clark | |
| 9,211,635 | B2 | 12/2015 | Poole | |
| 9,475,197 | B1 | 10/2016 | McAuley | |
| D782,928 | S | 4/2017 | Takakuwa | |
| D782,929 | S | 4/2017 | Takakuwa | |
| D782,930 | S | 4/2017 | Takakuwa | |
| D782,931 | S | 4/2017 | Takakuwa | |
| D850,880 | S | 6/2019 | Walters et al. | |
| 2003/0193122 | A1 * | 10/2003 | Nishimura | B25B 5/106 269/99 |
| 2005/0077666 | A1 | 4/2005 | Chang | |
| 2007/0267799 | A1 | 11/2007 | Dykstra | |
| 2011/0241246 | A1 | 10/2011 | Knox | |
| 2012/0043710 | A1 * | 2/2012 | Clark | B25B 5/006 269/55 |
| 2016/0046001 | A1 * | 2/2016 | Clark | B25B 5/08 269/100 |
| 2020/0338694 | A1 * | 10/2020 | Larkin | B25B 5/10 |

OTHER PUBLICATIONS

U.S. Appl. No. 16/289,124, Hall, filed Feb. 28, 2019.
Images of non-patent literature designs known prior to filing date of Feb. 28, 2019; 4 pages.
Kreg Tool Company; Bench Clamp Base; pages printed from the internet; date last visited May 28, 2019; https://www.kregtool.com/store/c29/bench-clamps/p433/bench-clamp-base/; 6 pages.
Kreg Tool Company; Bench Clamp; pages printed from the internet; date last visited May 28, 2019; https://www.ptreeusa.com/clamp_bench.htm; 11 pages.
Kreg Tool Company; Bench Dogs; pages printed from the internet; date last visited May 28, 2019; https://www.ptreeusa.com/clamp_bench_dogs.html; 3 pages.
Bench clamp, Product 1, known prior to Nov. 2, 2017; 1 page.
Bench clamp, Product 2, known prior to Nov. 2, 2017; 1 page.
Bench clamp, Product 3, known prior to Nov. 2, 2017; 1 page.
Bench clamp, Product 4, known prior to Nov. 2, 2017; 1 page.
Bench clamp, Product 5, known prior to Nov. 2, 2017; 1 page.
Bench clamp shown with high-profile horizontal clamp, Product 6, known prior to Nov. 2, 2017; 1 page.
Peachtree Woodworking Supply Inc.; Kreg Bench Clamps; pages from the internet; date last visited Feb. 1, 2018; https://www.ptreeusa.com/clamp_bench.htm; 10 pages.
Kreg Tool Company; Bench Clamp Base; pages from the internet; date last visited Feb. 1, 2018; https://www.kregtool.com/store/c29/bench-clamps/p433/bench-clamp-base/; 6 pages.
Peachtree Woodworking Supply Inc.; Kreg Bench Dogs; pages from the internet; date last visited Feb. 1, 2018; https://www.ptreeusa.com/clamp_bench_dogs.htm; 3 pages.
Peachtree Woodworking Supply Inc.; Clamps & Accessories; pages from the internet; date last visited Feb. 2, 2018; https://www.ptreeusa.com/clamp_brand_kreg.htm: 13 pages.

* cited by examiner

CLAMP MOUNT

FIELD OF THE INVENTION

This invention generally relates to clamps and particularly clamps mounted to a work bench.

BACKGROUND OF THE INVENTION

It is often required to clamp a workpiece or multiple workpieces for subsequent cutting, sanding, routing, drilling, attachment together, etc. Various types of clamps may be used, such as C-clamps, toggle clamps, bench clamps, etc. to clamp the workpiece to the work surface (e.g. work bench) or together.

It is desirable to be able to quickly and easily attach the clamp to the work bench without causing damage to the workbench. It is also desirable to be able to easily reposition the clamp relative to the workbench.

Some workbenches include holes as well as or alternatively T-channels that can be used to mount clamps to the work bench.

The present invention provides improvements over the current state of the art

BRIEF SUMMARY OF THE INVENTION

In an embodiment, a clamp mount for mounting a clamp having a mounting base proximate a work surface is provided. The clamp mount includes a base plate, a shoe, and a clamp mount mounting attachment. The base plate has a top surface and a bottom surface opposite the top surface. The shoe removably mounts to the base plate. The shoe covering at least a portion of the bottom surface of the base plate and exposing at least a portion of the top surface of the base plate. The clamp mount mounting attachment mounts the base plate proximate the work surface (this includes being directly mounted to the work surface). The clamp mount mounting attachment extends away from the bottom surface of the base plate.

In one embodiment, the shoe defines a pocket with the base plate being received in the pocket.

In one embodiment, the shoe includes a bottom wall portion, a top wall portion and a side wall portion extending between and connecting the bottom wall portion to the top wall portion. The pocket is formed between the bottom wall portion, top wall portion and side wall portion, the bottom wall portion being adjacent the bottom surface, the top wall portion being adjacent the top surface, with the base plate being positioned between the bottom wall portion and the top wall portion.

In one embodiment, the base plate is formed from metal and the shoe is formed from a plastic material.

In one embodiment, a clamp attachment extends outward from the base plate adjacent the top surface. The clamp attachment is configured to attach a clamp to the base plate.

In one embodiment, the clamp attachment is in the form of a threaded shaft extending axially outward from the top surface.

In one embodiment, the threaded shaft is part of a bolt extending through a first aperture in the base plate. The threaded shaft being connected to a head of the bolt. The shoe includes a first aperture that aligns with the first aperture in the base plate such that the head of the bolt is exposed when the shoe is attached to the base plate.

In one embodiment, the clamp mount mounting attachment includes a shaft, an enlarge head portion, and an adjustment mechanism. The shaft extends through a second aperture extending through the base plate. The enlarged head portion is attached to the shaft. The adjustment mechanism is attached to the shaft. The adjustment mechanism is adjacent the top surface and the enlarged head portion being proximate the bottom surface such that the base is positioned axially between the adjustment mechanism and the enlarged head portion. Spacing of the enlarged head portion relative to the bottom surface is adjustable by adjusting the position of the adjustment mechanism along the shaft.

In one embodiment, the shaft extends through a second aperture extending through the base plate. The attachment plate is operably connected to the shaft. The adjustment mechanism is attached to the shaft. The adjustment mechanism is adjacent the top surface and the attachment plate is proximate the bottom surface such that the base plate is positioned axially between the adjustment mechanism and the attachment plate. Spacing of the attachment plate relative to the bottom surface is adjustable by adjusting the position of the adjustment mechanism along the shaft. The attachment plate may be directly or indirectly attached to the shaft. In one embodiment, the attachment plate is directly welded to the shaft.

In one embodiment, the shoe has a second aperture that aligns with the second aperture of the base, the shaft extending through the second aperture of the shoe.

In one embodiment, the shoe includes a clamp abutment proximate the top surface, the clamp abutment preventing movement of the mounting base of the clamp relative to the base plate.

In one embodiment, the clamp abutment is a U-shaped wall positioned adjacent the top surface.

In one embodiment, a first attachment plate removably attachable to the enlarged head portion is provided. The first attachment plate has at least one dimension parallel to the bottom surface when the first attachment plate is attached to the enlarged head portion that is greater than a largest dimension of the enlarged head portion that is parallel to the bottom surface.

In one embodiment a second attachment plate removably attachable to the enlarged head portion is provided. The second attachment plate has at least one dimension parallel to the bottom surface when the second attachment plate is attached to the enlarged head portion that is greater than a largest dimension of the first attachment plate. This allows for mounting to different structures, e.g. different size T-channels.

In one embodiment, the adjustment mechanism is in the form of a fastener attached to the shaft. The fastener is positionable along the shaft.

In another embodiment, a clamp mount for mounting a clamp having a mounting base proximate a work surface is provided. The clamp mount includes a base plate and a clamp mount mounting attachment, and first and second attachment plates. The base plate has a top surface and a bottom surface opposite the top surface. The clamp mount mounting attachment mounts the base plate proximate the work surface. The clamp mount mounting attachment includes a shaft and an enlarged head portion. The shaft extends away from the bottom surface of the base plate. The enlarged head portion is attached to the shaft. The enlarged head portion is larger in dimension than the shaft. The first attachment plate is removably attachable to the enlarged head portion. The first attachment plate has at least one dimension parallel to the bottom surface when the first attachment plate is attached to the enlarged head portion that is greater than a largest dimension of the enlarged head portion that is parallel to the bottom surface. The second attachment plate is removably attachable to the enlarged head portion. The second attachment plate has at least one dimension parallel to the bottom surface when the second attachment plate is attached to the enlarged head portion that is greater than a largest dimension of the first attachment plate.

In one embodiment, each attachment plate includes a mounting aperture through which the shaft extends, the aperture being smaller than the largest dimension of the enlarged head portion.

In one embodiment, an adjustment mechanism is attached to the shaft. The adjustment mechanism is adjacent the top surface and the enlarged head portion is proximate the bottom surface such that the base plate is positioned axially between the adjustment mechanism and the enlarged head. Spacing of the enlarged head portion relative to the bottom surface is adjustable by adjusting the position of the adjustment mechanism along the shaft.

In another embodiment, a clamp mount for mounting a clamp having a mounting base proximate a work surface is provided. The clamp mount includes a base plate, a clamp mount mounting attachment and a clamp attachment. The base plate has a top surface and a bottom surface opposite the top surface. The clamp mount mounting attachment is for mounting the base plate proximate the work surface. The clamp mount mounting attachment extends away from the bottom surface of the base plate. The clamp attachment extends outward from the base plate adjacent the top surface. The clamp attachment is configured to attach a clamp to the base plate.

In one embodiment, the clamp attachment is in the form of a threaded shaft extending axially outward from the top surface.

In one embodiment, the threaded shaft is part of a bolt extending through a first aperture in the base plate. The threaded shaft is connected to a head of the bolt that is larger than the first aperture. The threaded shaft and head can be used to secure a clamp to the base plate.

In one embodiment, the clamp mount mounting attachment includes an oblong head portion spaced away from the bottom surface of the base plate. The oblong head portion can prevent rotation when mounted in a channel that has a dimension smaller than the larger dimension of the oblong configuration.

In one embodiment, the clamp mount mounting attachment includes a shaft connected to the oblong head portion. The shaft extends through the base plate and additionally away from the top surface of the base plate. The clamp mount mounting attachment further includes an adjustment mechanism attached to the shaft. The adjustment mechanism cooperating with the top surface of the base plate to adjust spacing of the oblong head portion relative to the bottom surface of the base plate.

In one embodiment, the oblong head portion can prevent rotation of the shaft such that an adjustment mechanism in the form of a nut or handle can be rotated relative to the shaft, e.g. if the shaft is a threaded shaft, to adjust the spacing. In alternative embodiments, the adjustment mechanism could be in the form of a handle with a cam arrangement that can be used to adjust the spacing of the oblong head portion relative to the bottom surface of the base plate.

In one embodiment, the adjustment mechanism is in the form of a fastener attached to the shaft, the fastener may be positionable along the shaft.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
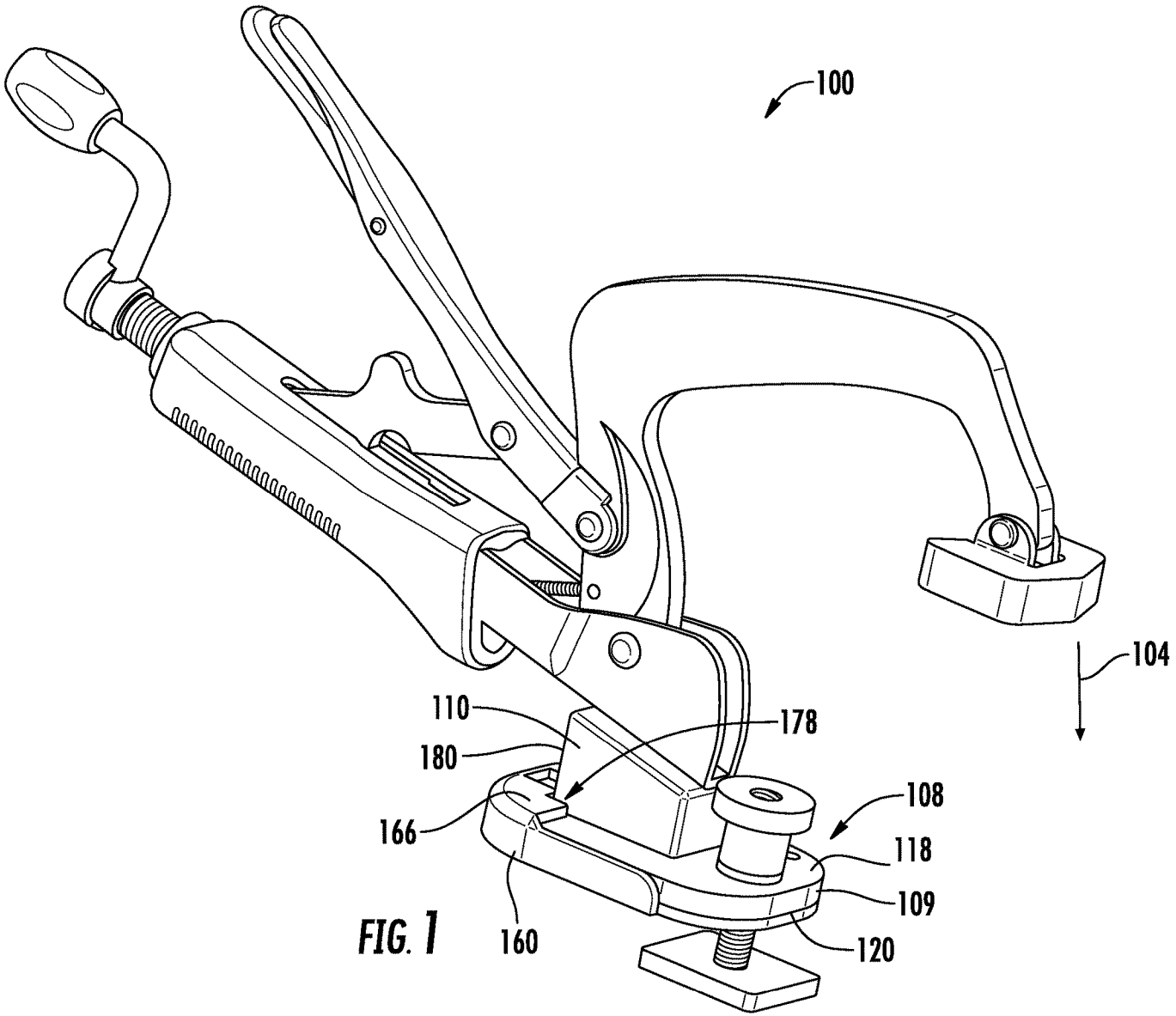
FIG. 1 is a clamp assembly according to an embodiment.

FIG. 1 illustrates a clamp arrangement 100 that can be mounted proximate to, which includes directly to, a work surface of a bench top of a workbench for clamping a workpiece to the work surface. The clamp arrangement 100 is releasably mountable such as by way of a hole extending through the bench top or to T-channel provided in, on or otherwise adjacent to the work surface.

The clamp arrangement 100 includes a clamp 102. The illustrated clamp 102 is a single jaw, over-center locking clamp that can be used to provide a force 104 to clamp one or more workpieces to the work surface. While a particular clamp is illustrated, embodiments can use other types of clamps such as toggle clamps, clamps with a threaded jaw/clamping member, etc.

The clamp arrangement 100 also includes a clamp mount 108 for mounting the clamp 102.

Figure 2:
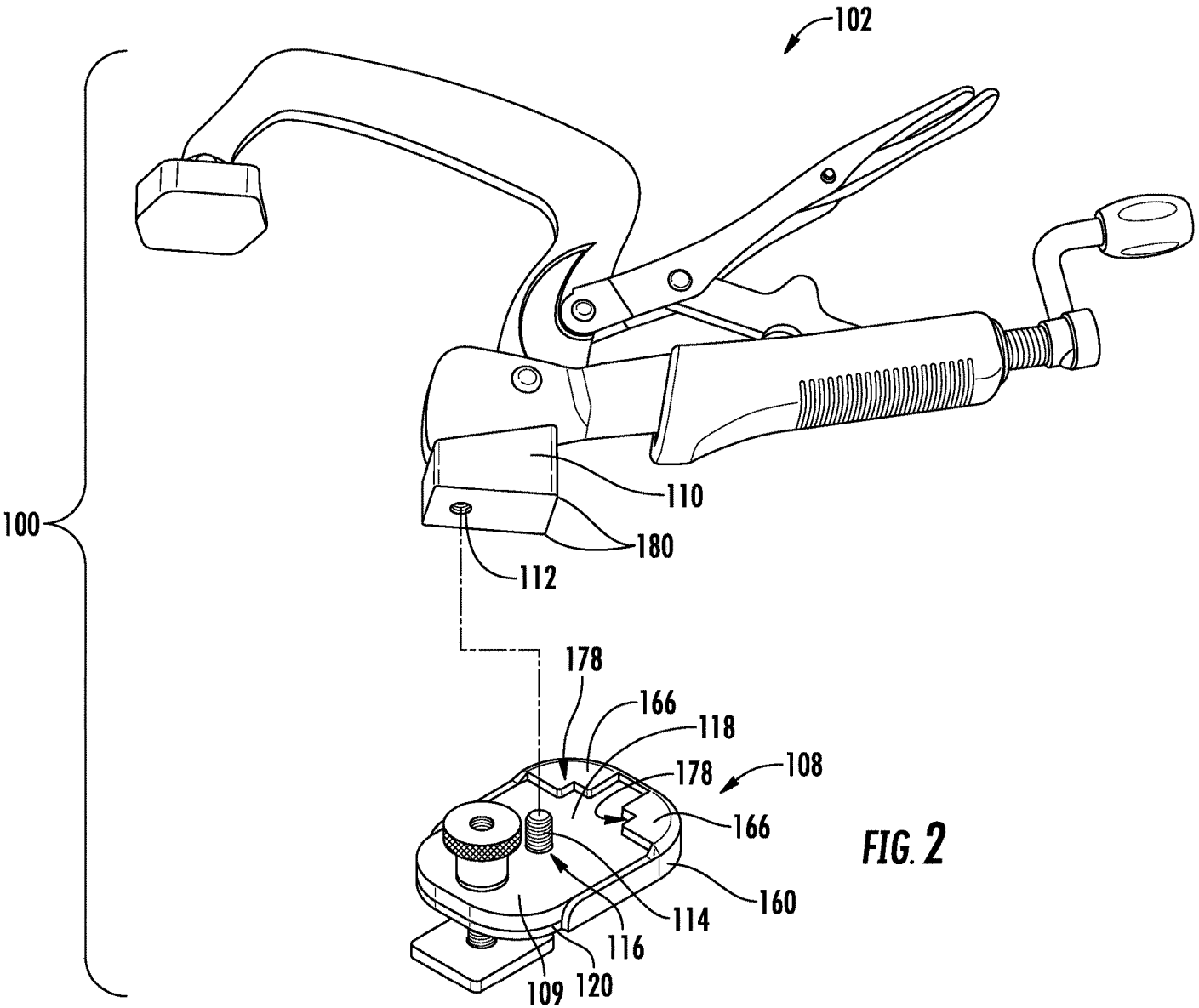
FIG. 2 is a partially exploded illustration of the clamp assembly of FIG. 1.

The clamp 102 includes, among other things, a clamp base 110 that is configured to attach to the clamp mount 108 to attach the clamp 102 to the clamp mount 108. In the illustrated embodiment, the clamp base 110 includes a threaded aperture 112 (see FIG. 2) that cooperates with a clamp attachment of the clamp mount 108. In the illustrated embodiment, the clamp attachment is in the form of a threaded post that extends outward from a top surface 116 of a base plate 109. More particularly, the threaded post is provided by a screw 114, which may also be referred to as a bolt that extends through an aperture 116 extending through the base plate 109. The threaded post extends outward from a top surface 118 of the base plate 109.

In other embodiments, the threaded post could instead be directly secured to the base plate 109, e.g. by way of being welded to top surface 118. Screw 114 may be rotated within aperture 116.

As such, to attach the clamp 102 to the clamp mount 108, the user will thread screw 114 into aperture 112. The screw 114 will extend through aperture 116 of the base plate 109. The screw 114 will be inserted into the aperture 116 from the bottom surface 120 side of the base plate 109. The screw 114 has an enlarged head 124 connected to the threaded shaft that is larger in diameter than aperture 116 such that base plate 109 is secured to bottom surface 120 of clamp base 110 when screw 114 is tightened.

To secure the clamp assembly 100 to the work bench or other support and proximate to, which includes directly to, the work surface, a clamp mount mounting attachment is provided. The clamp mount mounting attachment extends, at least in part, away from the bottom surface 120 of the base plate 109.

Figure 11:
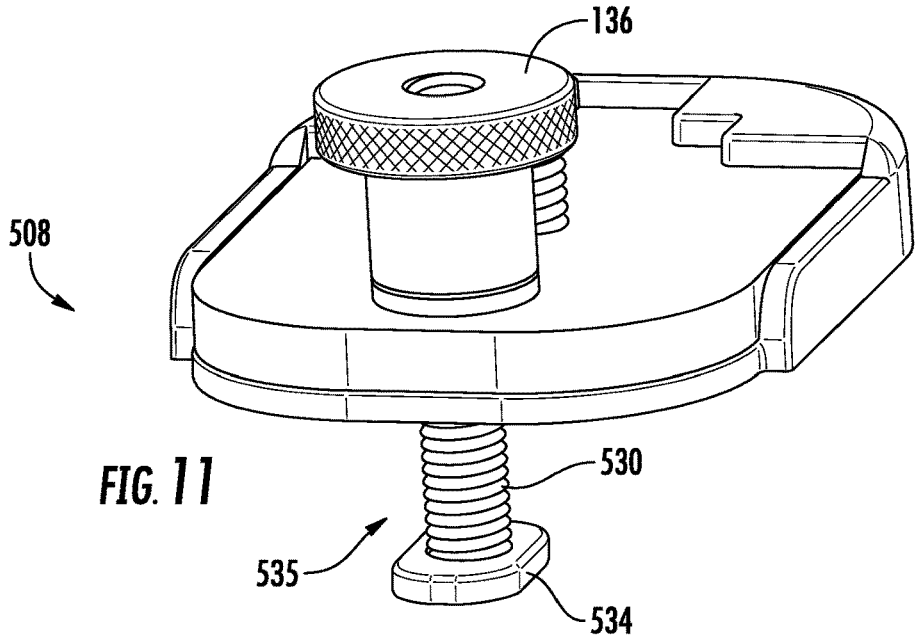

In the illustrated embodiment, the clamp mount mounting attachment includes a shaft 130 that extends through a second aperture 132 in base plate 109. An enlarged head portion 134 is attached to shaft 130. The shaft 130 and head portion 134 could take the form of a t-bolt. In some embodiments, the t-bolt can be used without the use of attachment plates 140, 142 described below (see. e.g. clamp mount 508 in FIG. 11, which includes t-bolt 535 formed by shaft 530 and head portion 534).

In the illustrated embodiment, an adjustment mechanism is attached to shaft 130. In this embodiment, the adjustment mechanism is in the form of fastener and more particularly in the form of a threaded knob 136 that cooperates with corresponding threads of shaft 130. The threaded knob 136 is on an opposite side of the base plate 109 as enlarged head portion 134 (e.g. threaded knob 136 is proximate top surface 118 while enlarged head portion 134 is proximate bottom surface 120 with the base plate 109 positioned axially therebetween).

Other adjustment mechanisms are contemplated. For example a handle with a cam surface that cooperates with the top surface 118 of the base plate to adjust the position of shaft 130 could be used. Alternatively, shaft 130 could have a plurality of notches or holes therein that cooperate with a pin, clip, pawl or other mechanism to adjust the positioning of shaft 130.

A spacing between the enlarged head portion 134 and the bottom surface 120 can be adjusted by adjusting the position of the adjustment mechanism, e.g. threaded knob 136 along shaft 130. This can be done by rotating the threaded knob 136. This allows the clamp mount mounting attachment to be used to attach the clamp mount 108, and consequently a clamp 102) to T-channels or workbenches that have different configurations and thicknesses.

To improve mounting of the clamp mount 108 to a workbench, attachment plates 140, 142 may be provided. The attachment plates 140, 142 are removably attachable to shaft 130 and enlarged head 134. More particularly, shaft 130 extends through aperture 144, 146 of corresponding plate 140, 142. Enlarged head 134 is larger than apertures 144, 146 in at least one dimension.

The attachment plates 140, 142 are used to better distribute the mounting force when attaching the clamp mount by providing a larger foot print than the enlarged head. While two attachment plates 140, 142 are illustrated, more or fewer than two attachment plates 140, 142 may be provided. The attachment plates also all for use with different sized T-channels As such, the attachment plates 140, 142 at least one dimension (e.g. corresponding dimension D2 and D3) that is parallel to the bottom surface 120 that is greater than a largest dimension D1 of the enlarged head portion 134 that is parallel to bottom surface 120 when the clamp mount 108 is assembled. In the illustrated arrangement, attachment plate 142 is larger than attachment plate 140 such that dimension D3 is greater than corresponding dimension D2.

Figure 5:
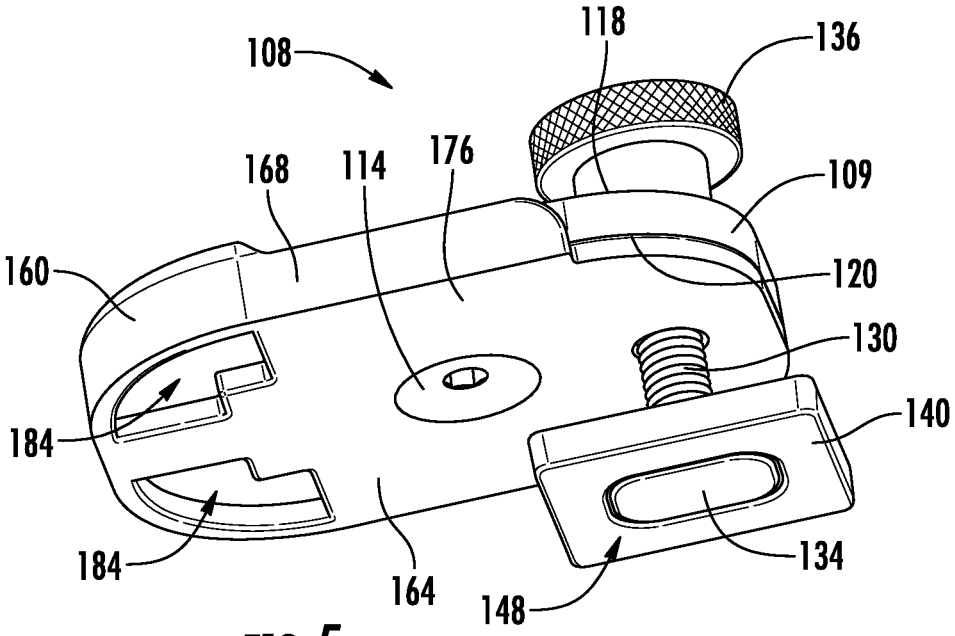

With reference to FIG. 5, attachment plate 140 includes an oblong recess 148 that receives enlarged head portion 134. The enlarged head portion 134 preferably has a corresponding and cooperating profile.

Figure 6:
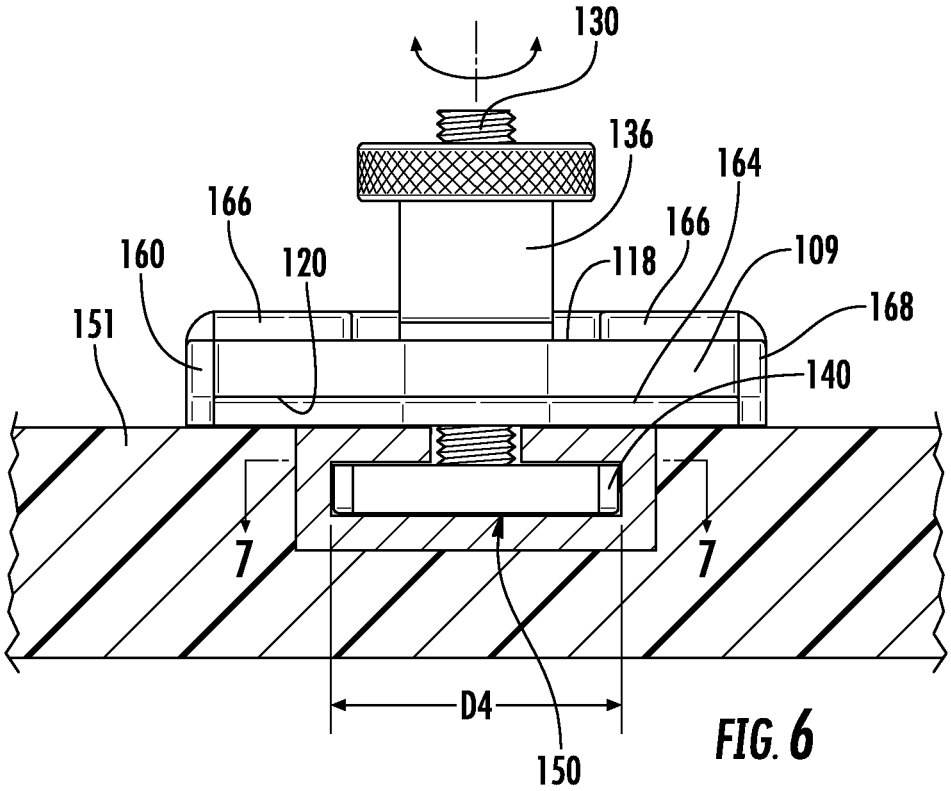
FIG. 6 is a partial cross-sectional illustration of the clamp mount of the clamp assembly of FIG. 1 mounted to a workpiece support.
Figure 7:
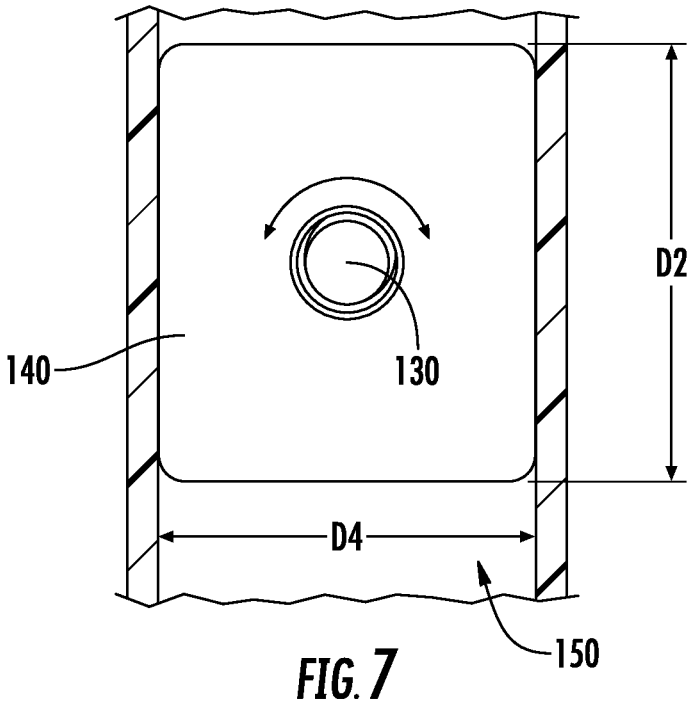
FIG. 7 is a cross-sectional image taken about line 7-7 in FIG. 6.

With additional reference to FIGS. 6 and 7, when the attachment plate 140 is slid into a T-channel 150 that is mounted to a workbench 151 with the T-channel 150 having a size that is configured to prevent the attachment plate 140 from rotating a full 360 degrees, the attachment plate recess 148 can engage enlarged head portion 134 and prevent 360 degree rotation of the enlarged head portion 134 and consequently shaft 130. As illustrated in FIG. 6, dimension D2 of attachment plate 140 is greater than dimension D4 of T-channel 150 such that attachment plate 140 cannot rotate within T-channel 150.

Thus, when mounting to a T-channel 150, this allows the user to tighten the threaded knob 136 along shaft 130 without having to engage the threaded shaft 130 or head portion 134. The user simply need only rotate threaded knob 136 to tighten or loosen the mounting of the clamp mount 108. While only attachment plate 140 is illustrated, attachment plate 142 preferably has the same configuration.

It is noted that with the oblong shape for enlarged head portion 134, head portion 134 itself could be used in a correspondingly sized T-channel 150 for mounting purposes. For example, if dimension D1 is greater than dimension D4 of the T-channel 150. Typically, the T-channel is provided by a C-shaped rail mounted to the workbench 151. Typically, the C-shaped rail is metal but could be provided by plastic. Further, in some embodiments, the T-channel could be formed directly into the work bench 151.

The C-shaped rail provides inward extending flanges that provide undercuts that help form the shape of the T-channel. The mouth formed between the inward extending flanges is narrower than the main portion of the T-channel to form the undercuts. A T-channel can be used with any of the clamp mount embodiments described herein.

Figure 3:
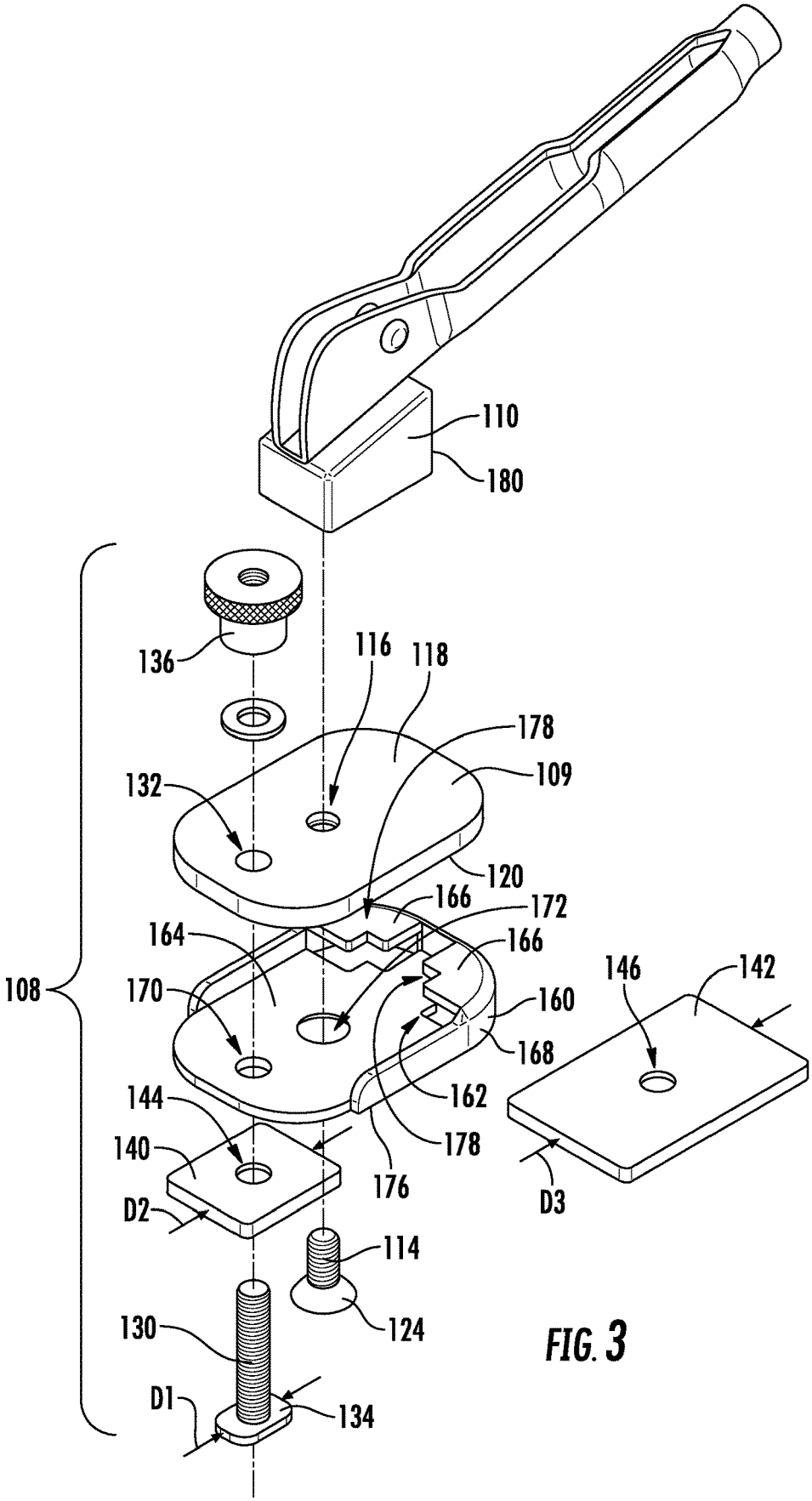
FIG. 3 is an exploded illustration of the clamp mount of the clamp assembly of FIG. 1.
Figure 4:
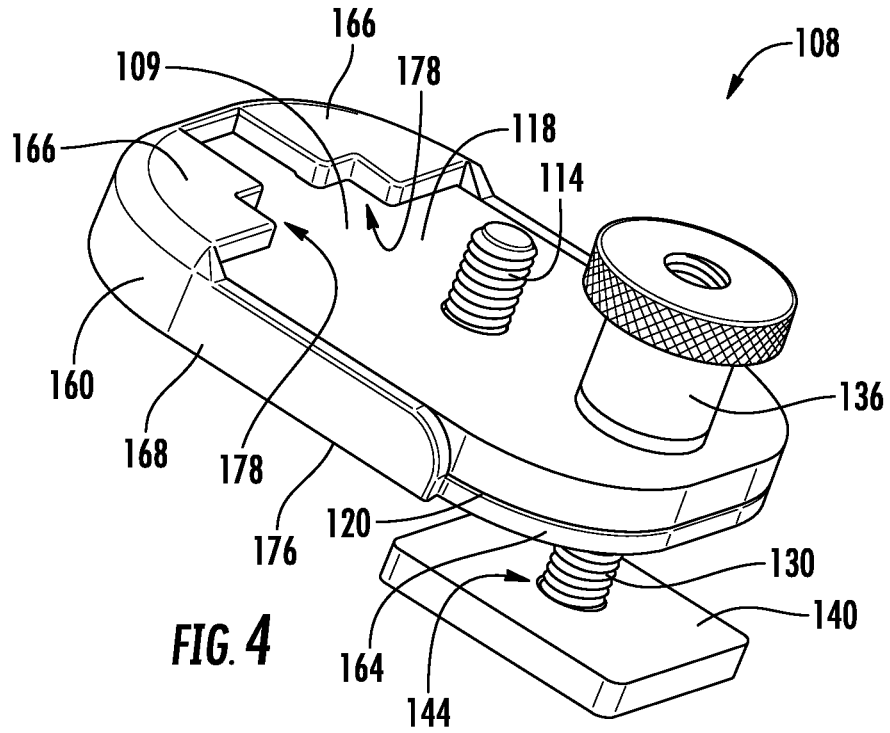
FIGS. 4 and 5 are perspective illustrations of the clamp mount of the clamp assembly of FIG. 1.

With reference to FIGS. 3-5, the clamp mount 108 further includes a shoe 160. The shoe 160 is preferably, but not necessarily, removable from the base plate 109. The shoe 160 provides a scratch reducing mounting barrier that reduces scratching of the object to which the clamp mount 108 is attached.

The shoe 160 covers, at least in part, a portion of the bottom surface 120 of the base plate 109. While not necessary, the shoe 160 also exposes, at least in part, a portion of the top surface 118 of the base plate 109.

The shoe 160 provides a pocket 162 (see FIG. 3) that receives the base plate 109. The pocket 162 assists in mounting the shoe 160 to base plate 109. In the illustrated embodiment, the pocket is defined, at least in part, by a bottom wall portion 164, one or more top wall portions 166, and a sidewall portion 168 extending between and connecting the top wall portions 166 and bottom wall portion 164.

When mounted, the bottom wall portion 164 is adjacent the bottom surface 120 while the top wall portions are adjacent the top surface 118 with the base plate 109 positioned therebetween when in a mounted state.

Preferably, the base plate 109 is formed from a material that is more rigid than the shoe 160. In one embodiment, the base plate 109 is formed from metal, such as aluminum or steel, while the shoe 160 is formed from a polymer, plastic or rubber. The shoe 160 could have either low friction characteristics or a gripping surface depending on the desired interaction between the shoe and the object to which clamp mount 108 is mounted. For instance, if is desired to make it easy to change the position of the clamp assembly 100 along a T-channel, low friction characteristics may be provided. Alternatively, if it is desire to prevent rotation of the clamp assembly relative to the work bench, a gripping surface such as a rubber could be provided.

In the illustrated embodiment, the bottom wall portion 164 includes a first aperture 170 that aligns with aperture 132 in base plate 109 when mounted. Shaft 130 extends axially through both apertures 132 and 170 for mounting purposes.

The bottom wall portion 164 includes a second aperture 172 that aligns with aperture 116 that allows the screw 114 to extend through both apertures 116, 172. Preferably, aperture 172 is configured such that the head of screw 114 is recessed relative to or flush with bottom surface 176 of bottom wall portion 164 so as to prevent screw 114 contacting the work bench 151 or other object to which the clamp mount 108 is mounted.

The shoe 160 defines a clamp abutment proximate the top surface 118 of the base plate 109 that prevents movement, and particularly rotation, of the mounting base 110 of the clamp 102 relative to the base plate 109.

The clamp abutment in the illustrated embodiment is a pair of notches 178 formed in each top wall portion 166. The notches 178 engage the corners 180 of the clamp base 110 (see e.g. FIGS. 1 and 2). The engagement therebetween prevents the clamp base 110 from rotating angularly about the axis defined by screw 114. This can reduce the risk of loosening of screw 114 during manipulation of clamp assembly 100.

Notches 178 generally form a U-shaped wall that receives the corresponding portion of clamp base 110.

While two separate top wall portions 166 are provided, a single wall portion could be provided. The single top wall portion could provide the U-shaped wall that receives the corresponding portion of clamp base 110.

To improve molding, the bottom wall portion 164 includes a pair of apertures 184 aligned with top wall portions 166.

Figure 8:
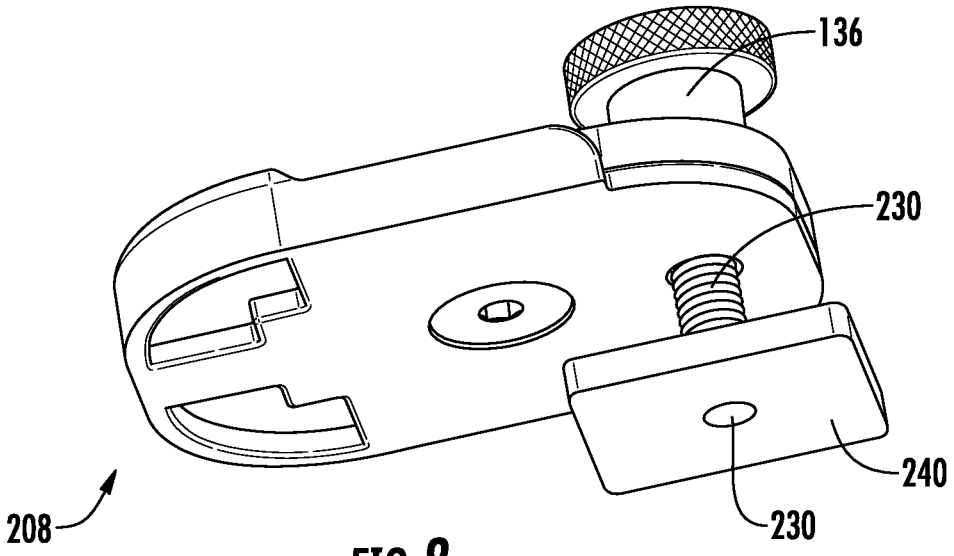
FIGS. 8-11 is are alternative embodiments of clamp mounts.

FIG. 8 illustrates a further embodiment of a clamp mount 208. The clamp mount is substantially the same as that described in FIGS. 1-7. However, in this embodiment, the shaft 230 is permanently attached to the attachment plate 240. More particularly, shaft 230 may be welded or adhesively secured to attachment plate 240.

In the illustrated embodiment, the shaft 230 extends into an aperture in the attachment plate 240. This improves alignment and attachment therebetween.

In other embodiments, the shaft 230 could be welded to an outward facing surface of the attachment plate 240.

In other embodiments, it is contemplated that shaft 230 could simply thread into attachment plate 240.

Figure 9:
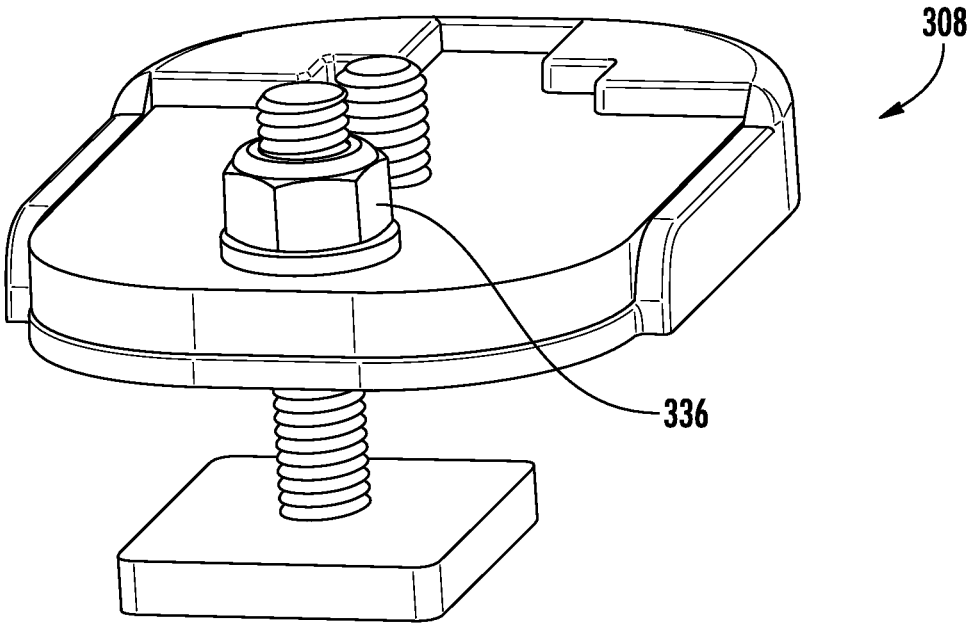

FIG. 9 illustrates a further embodiment of a clamp mount 308 where the fastener is in the form of a nut 336 and particularly a nylock lock nut. However, other nuts are contemplated. The attachment plate 340 could be the same as attachment plate 240 or could be the same as attachment plates 140, 142. Further yet, a t-bolt similar to FIG. 11 could be used. Further yet, an attachment plate 440 of the embodiment of FIG. 10 could be used.

Figure 10:
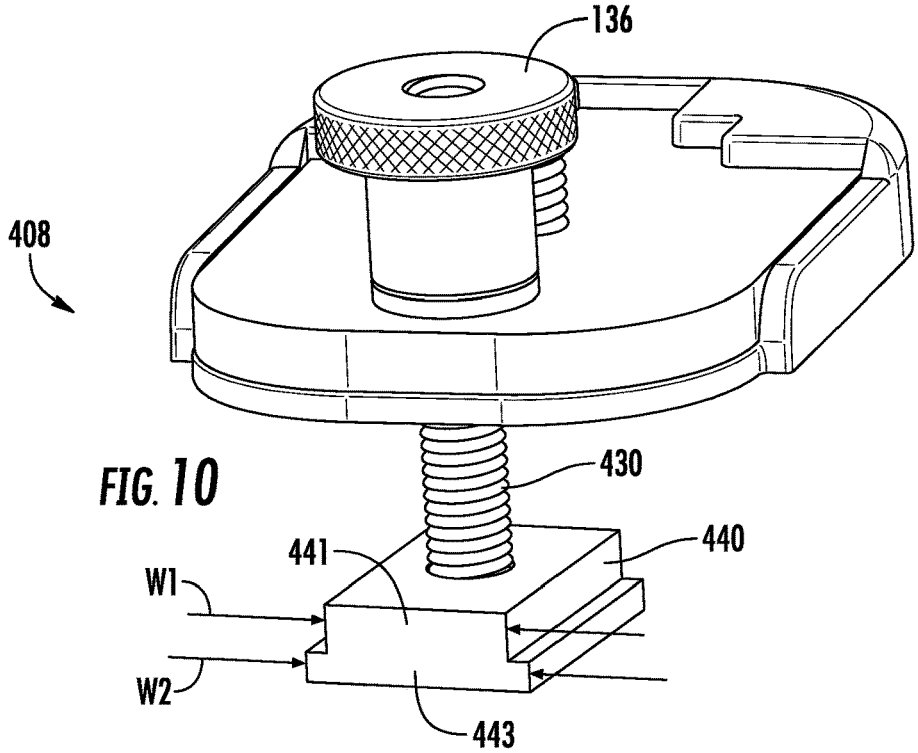

FIG. 10 illustrates a further embodiment of a clamp mount 408. The attachment plate 440 has an inverted T-shape including a first portion 441 having a first width W1 and a second portion 443 having a second width W2 that is greater than width W1 of the first portion 441. Different sized attachment plates could be used similar to the embodiment of FIG. 3. The attachment plate 440 could be permanently attached to shaft 430, threadedly attached or a t-bolt configuration similar to FIGS. 3 and 5 could be used.

In this embodiment, the attachment plate 440 is designed for use in a T-track. The T-track would be similar to the C-shaped rail described above and provide a T-channel. However, it would have different dimensions. Typically, it would have a larger mouth than in the prior C-shaped rail to accommodate the greater width W1 of the T-shape of the attachment plate 440.

Figure 12:
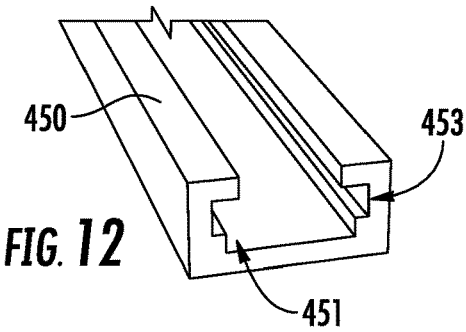
FIG. 12 is a T-track that various embodiments of the clamp mount can cooperate with to attach the clamp mount to a work bench.

FIG. 12 includes a representative T-track 450 that can be used. In such an embodiment, the attachment plate 440 could be inverted as illustrated in FIG. 10. In such a configuration, portion 441 would locate in portion 451 of the channel of T-track 450 while portion 443 would locate in portion 453 of the channel of T-track 450.

The shoe features of the embodiment of FIGS. 1-7 are equally applicable to the embodiments of FIGS. 8-11.

As noted above FIG. 11 is similar to the embodiment of FIGS. 1-7. However, in this embodiment, no attachment plate 140 is provided. Instead, the t-bolt and enlarged head portion thereof is used to attach the clamp mount 508.

While the prior embodiments incorporate the use of a shoe, other embodiments could eliminate the use of the shoe but would have all of the other features or configurations of the prior embodiments.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A clamp mount for mounting a clamp having a mounting base proximate a work surface, the clamp mount comprising:

a base plate having a top surface and a bottom surface opposite the top surface;

a shoe removably mounted to the base plate, the shoe covering at least a portion of the bottom surface of the base plate and exposing at least a portion of the top surface of the base plate;

a clamp mount mounting attachment for mounting the base plate proximate the work surface, the clamp mount mounting attachment extending away from the bottom surface of the base plate;

wherein the shoe defines a pocket, the base plate being received in the pocket;

wherein the shoe includes a bottom wall portion, a top wall portion and a side wall portion extending between and connecting the bottom wall portion to the top wall portion, the pocket being formed between the bottom wall portion, top wall portion and side wall portion, the bottom wall portion being adjacent the bottom surface, the top wall portion being adjacent the top surface, with the base plate being positioned between the bottom wall portion and the top wall portion.

2. The clamp mount of claim 1, further comprising a clamp attachment extending outward from the base plate adjacent the top surface, the clamp attachment is configured to attach the clamp to the base plate; and wherein the clamp mount mounting attachment secures the shoe to the base plate.

3. The clamp mount of claim 2, wherein the clamp attachment is in the form of a threaded shaft extending axially outward from the top surface.

4. The clamp mount of claim 3, wherein the threaded shaft is part of a bolt extending through a first aperture in the base plate, the threaded shaft being connected to a head of the bolt that is larger than the first aperture.

5. The clamp mount of claim 2, wherein the clamp mount mounting attachment includes an oblong head portion spaced away from the bottom surface of the base plate.

6. A clamp mount for mounting a clamp having a mounting base proximate a work surface, the clamp mount comprising:

a base plate having a top surface and a bottom surface opposite the top surface;

a shoe removably mounted to the base plate, the shoe covering at least a portion of the bottom surface of the base plate and exposing at least a portion of the top surface of the base plate, the shoe having a bottom surface that rests on the work surface, in use;

a clamp mount mounting attachment for mounting the base plate proximate the work surface, the clamp mount mounting attachment extending away from the bottom surface of the base plate, the clamp mount mounting attachment extending outward beyond the bottom surface of the shoe; and wherein the shoe defines a pocket, the base plate being received in the pocket;

wherein the clamp mount mounting attachment includes:

a shaft extending through a first aperture extending through the base plate;

an enlarged head portion attached to the shaft;

an adjustment mechanism attached to the shaft, the adjustment mechanism being adjacent the top surface and the enlarged head portion being proximate the bottom surface of the shoe such that the base plate is positioned axially between the adjustment mechanism and the enlarged head portion; and wherein spacing of the enlarged head portion relative to the bottom surface of the shoe is adjustable by adjusting a position of the adjustment mechanism along the shaft.

7. The clamp mount of claim 6, further comprising a clamp attachment extending outward from the base plate adjacent the top surface, the clamp attachment is configured to attach the clamp to the base plate.

8. The clamp mount of claim 7, wherein the clamp attachment is in the form of a threaded shaft extending axially outward from the top surface.

9. The clamp mount of claim 8, wherein:

the threaded shaft is part of a bolt extending through a second aperture in the base plate, the threaded shaft being connected to a head of the bolt; the shoe including a first aperture that aligns with the second aperture in the base plate such that the head of the bolt is exposed when the shoe is attached to the base plate.

10. The clamp mount of claim 6, wherein the shoe has a first aperture that aligns with the first aperture of the base plate, the shaft extending through the first aperture of the shoe.

11. The clamp mount of claim 6, wherein the adjustment mechanism is in the form of a fastener attached to the shaft, the fastener is positionable along the shaft.

12. A clamp mount for mounting a clamp having a mounting base proximate a work surface, the clamp mount comprising:

a base plate having a top surface and a bottom surface opposite the top surface;

a shoe removably mounted to the base plate, the shoe covering at least a portion of the bottom surface of the base plate and exposing at least a portion of the top surface of the base plate;

a clamp mount mounting attachment for mounting the base plate proximate the work surface, the clamp mount mounting attachment extending away from the bottom surface of the base plate;

wherein the clamp mount mounting attachment includes:

a shaft extending through a first aperture extending through the base plate;

an enlarged head portion attached to the shaft;

an adjustment mechanism attached to the shaft, the adjustment mechanism being adjacent the top surface and the enlarged head portion being proximate the bottom surface such that the base plate is positioned axially between the adjustment mechanism and the enlarged head portion;

wherein spacing of the enlarged head portion relative to the bottom surface is adjustable by adjusting a position of the adjustment mechanism along the shaft; and further comprising a first attachment plate removably attachable to the enlarged head portion, the first attachment plate having at least one dimension parallel to the bottom surface when the first attachment plate is attached to the enlarged head portion that is greater than a largest dimension of the enlarged head portion that is parallel to the bottom surface.

13. The clamp mount of claim 12, further comprising a second attachment plate removably attachable to the enlarged head portion, the second attachment plate having at least one dimension parallel to the bottom surface when the second attachment plate is attached to the enlarged head portion that is greater than a largest dimension of the first attachment plate.

14. A clamp mount for mounting a clamp having a mounting base proximate a work surface, the clamp mount comprising:

a base plate having a top surface and a bottom surface opposite the top surface;

a shoe removably mounted to the base plate, the shoe covering at least a portion of the bottom surface of the base plate and exposing at least a portion of the top surface of the base plate;

a clamp mount mounting attachment for mounting the base plate proximate the work surface, the clamp mount mounting attachment extending away from the bottom surface of the base plate;

wherein the clamp mount mounting attachment includes:

a shaft extending through a first aperture extending through the base plate;

an attachment plate operably connected to the shaft;

an adjustment mechanism attached to the shaft, the adjustment mechanism being adjacent the top surface and the attachment plate being proximate the bottom surface such that the base plate is positioned axially between the adjustment mechanism and the attachment plate; and wherein spacing of the attachment plate relative to the bottom surface is adjustable by adjusting a position of the adjustment mechanism along the shaft.

15. A clamp mount for mounting a clamp having a mounting base proximate a work surface, the clamp mount comprising:

a base plate configured to mount the clamp thereto, the base plate having a top surface and a bottom surface opposite the top surface;

a clamp mount mounting attachment for mounting the base plate proximate the work surface, the clamp mount mounting attachment including:

a shaft extending away from the bottom surface of the base plate;

an enlarged head portion attached to the shaft;

a first attachment plate removably attachable to the enlarged head portion, the first attachment plate having at least one dimension parallel to the bottom surface when the first attachment plate is attached to the enlarged head portion that is greater than a largest dimension of the enlarged head portion that is parallel to the bottom surface; and a second attachment plate removably attachable to the enlarged head portion, the second attachment plate having at least one dimension parallel to the bottom surface when the second attachment plate is attached to the enlarged head portion that is greater than a largest dimension of the first attachment plate.

16. The clamp mount of claim 15, wherein each attachment plate includes a mounting aperture through which the shaft extends, the aperture being smaller than the largest dimension of the enlarged head portion.

17. The clamp mount of claim 15, further comprising an adjustment mechanism attached to the shaft, the adjustment mechanism being adjacent the top surface and the enlarged head portion being proximate the bottom surface such that the base plate is positioned axially between the adjustment mechanism and the enlarged head portion; and wherein spacing of the enlarged head portion relative to the bottom surface is adjustable by adjusting a position of the adjustment mechanism along the shaft.

18. The clamp mount of claim 17, wherein the adjustment mechanism is in the form of a fastener attached to the shaft, the fastener is positionable along the shaft.

19. A clamp mount for mounting a clamp having a mounting base proximate a work surface, the clamp mount comprising:

a base plate having a top surface and a bottom surface opposite the top surface;

a shoe removably mounted to the base plate, the shoe covering at least a portion of the bottom surface of the base plate and exposing at least a portion of the top surface of the base plate, the shoe having a bottom surface that rests on the work surface, in use;

a clamp mount mounting attachment for mounting the base plate proximate the work surface, the clamp mount mounting attachment extending away from the bottom surface of the base plate, the clamp mount mounting attachment extending outward beyond the bottom surface of the shoe;

wherein the shoe defines a pocket, the base plate being received in the pocket; and wherein the base plate is formed from metal and the shoe is formed from a plastic material;

a clamp attachment extending outward from the base plate adjacent the top surface, the clamp attachment is configured to attach the clamp to the base plate; and wherein the clamp mount mounting attachment secures the shoe to the base plate;

wherein the clamp mount mounting attachment includes an oblong head portion spaced away from the bottom surface of the base plate; and wherein the clamp mount mounting attachment includes a shaft connected to the oblong head portion, the shaft extending through the base plate and additionally away from the top surface of the base plate, the clamp mount mounting attachment further including an adjustment mechanism attached to the shaft, the adjustment mechanism cooperating with the top surface of the base plate to adjust spacing of the oblong head portion relative to the bottom surface of the base plate.

20. A clamp mount for mounting a clamp having a mounting base proximate a work surface, the clamp mount comprising:

a base plate having a top surface and a bottom surface opposite the top surface;

a shoe removably mounted to the base plate, the shoe covering at least a portion of the bottom surface of the base plate and exposing at least a portion of the top surface of the base plate;

a clamp mount mounting attachment for mounting the base plate proximate the work surface, the clamp mount mounting attachment extending away from the bottom surface of the base plate;

wherein the shoe includes a clamp abutment proximate the top surface, the clamp abutment preventing rotation of the mounting base of the clamp relative to the base plate;

wherein the clamp mount mounting attachment is directly attached to the base plate.

21. The clamp mount of claim 20, wherein the clamp abutment is a U-shaped wall positioned adjacent the top surface.

22. A clamp mount for mounting a clamp having a mounting base proximate a work surface, the clamp mount comprising:

a base plate having a top surface and a bottom surface opposite the top surface;

a shoe removably mounted to the base plate, the shoe covering at least a portion of the bottom surface of the base plate and exposing at least a portion of the top surface of the base plate;

a clamp mount mounting attachment for mounting the base plate proximate the work surface, the clamp mount mounting attachment extending away from the bottom surface of the base plate;

wherein the shoe includes a clamp abutment proximate the top surface, the clamp abutment preventing rotation of the mounting base of the clamp relative to the base plate; and wherein the clamp mount mounting attachment extends into an aperture in the base plate.

* * * * *